US008188400B2

(12) United States Patent
Lee

(10) Patent No.: US 8,188,400 B2
(45) Date of Patent: May 29, 2012

(54) WIRELESS DONGLE

(75) Inventor: Tsung-Shih Lee, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 228 days.

(21) Appl. No.: 12/694,282

(22) Filed: Jan. 27, 2010

(65) Prior Publication Data

US 2011/0180380 A1 Jul. 28, 2011

(51) Int. Cl.
*H01H 1/14* (2006.01)

(52) U.S. Cl. ..... 200/534; 361/679.32

(58) Field of Classification Search ..... 200/534, 200/520; 361/679.32
See application file for complete search history.

(56) References Cited

U.S. PATENT DOCUMENTS 7,423,867 B2 * 9/2008 Yamamoto et al. ..... 361/679.32
2008/0251369 A1 * 10/2008 Villain et al. ..... 200/534

* cited by examiner

*Primary Examiner* — Vanessa Girardi
(74) *Attorney, Agent, or Firm* — Lin & Associates IP, Inc.

(57) ABSTRACT

A wireless dongle includes a shell having a base board of which an appropriate portion is made of elastic materials to be acted as a switch section, a printed circuit board mounted in the shell and spaced from the base board of the shell, and an elastic member made of elastic materials. The printed circuit board defines a contact area facing toward the switch section of the shell. The elastic member is mounted between the switch section of the shell and the contact area of the printed circuit board, and further spaced from the contact area. The elastic member can be elastically pressed to contact the contact area of the printed circuit board by means of pressing the switch section of the shell against the elastic member so as to trigger an electrical signal.

1 Claim, 4 Drawing Sheets

WIRELESS DONGLE

BACKGROUND OF THE INVENTION

1. Field of the Invention

The present invention relates to a dongle, and more particularly to a wireless dongle.

2. The Related Art

A wireless mouse or wireless keyboard achieves a signal transmission with a computer host often by means of an external dongle connected with the computer host. The dongle usually sets up a button to control working statuses thereof. However, the button of the conventional dongle generally has a complicated and bulky structure that is disadvantageous to the miniaturization of the dongle and further results in a relatively higher production cost. Therefore, a wireless dongle capable of overcoming the foregoing problems is required.

SUMMARY OF THE INVENTION

An object of the present invention is to provide a wireless dongle. The wireless dongle includes a shell having a base board of which an appropriate portion is made of elastic materials to be acted as a switch section, a printed circuit board mounted in the shell and spaced from the base board of the shell, and an elastic member made of elastic materials. The printed circuit board defines a contact area facing toward the switch section of the shell. The elastic member is mounted between the switch section of the shell and the contact area of the printed circuit board, and further spaced from the contact area. The elastic member can be elastically pressed to contact the contact area of the printed circuit board by means of pressing the switch section of the shell against the elastic member so as to trigger an electrical signal.

As described above, the switch section made of elastic materials is designed with the appropriate portion of the base board instead of an external dedicated button in the prior art. Thus, it can reduce a space requirement and advantageously lower a production cost.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
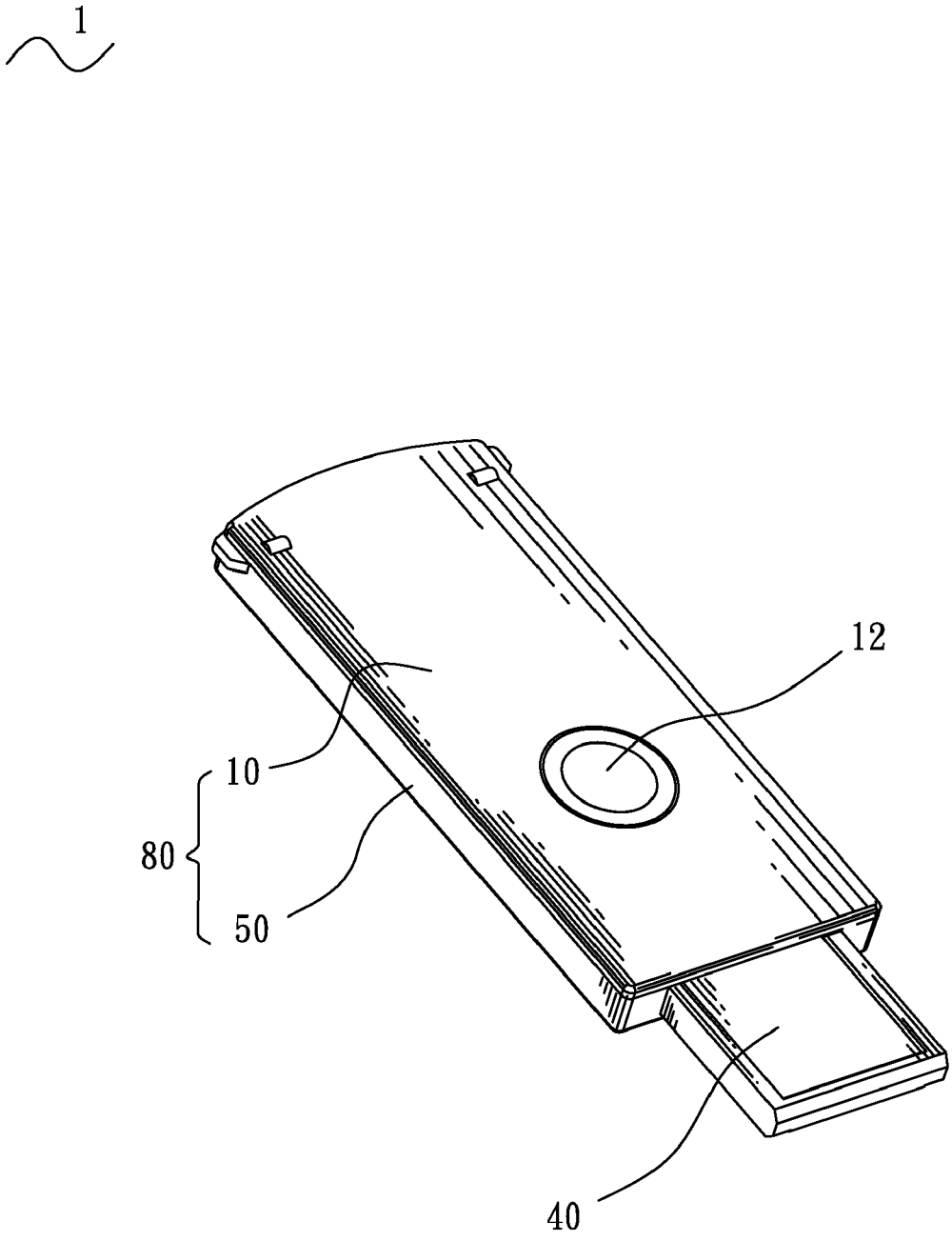
FIG. 1 is a perspective view of a wireless dongle according to the present invention.
Figure 2:
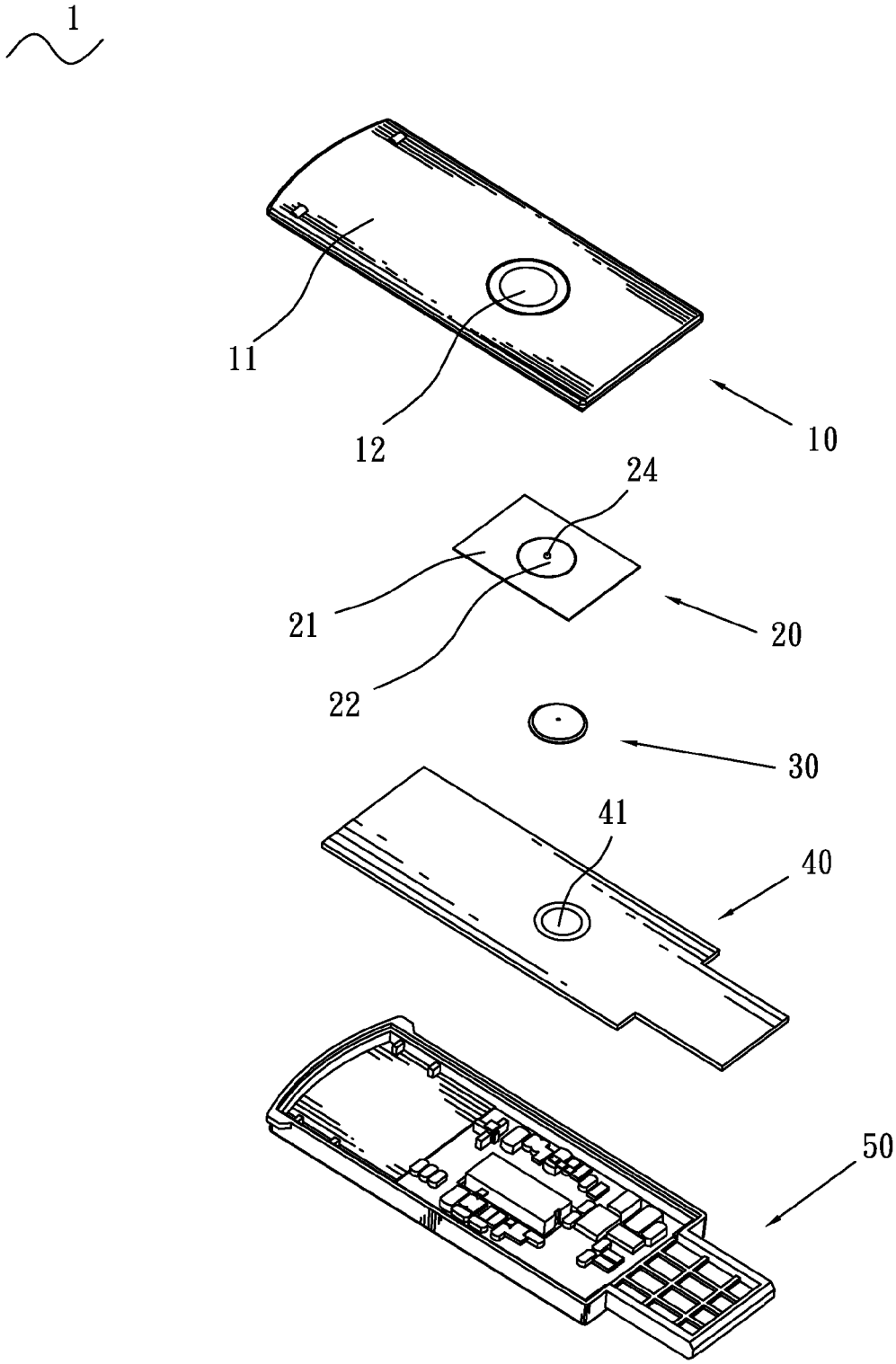
FIG. 2 is an exploded view of the wireless dongle of FIG. 1.

Referring to FIG. 1 and FIG. 2, a wireless dongle 1 according to the present invention includes a shell 80, a restraining member 20, an elastic member 30 and a printed circuit board 40 mounted in the shell 80 respectively, wherein the shell 80 includes an upper cover 10 and a lower cover 50 mated with the upper cover 10.

Figure 3:
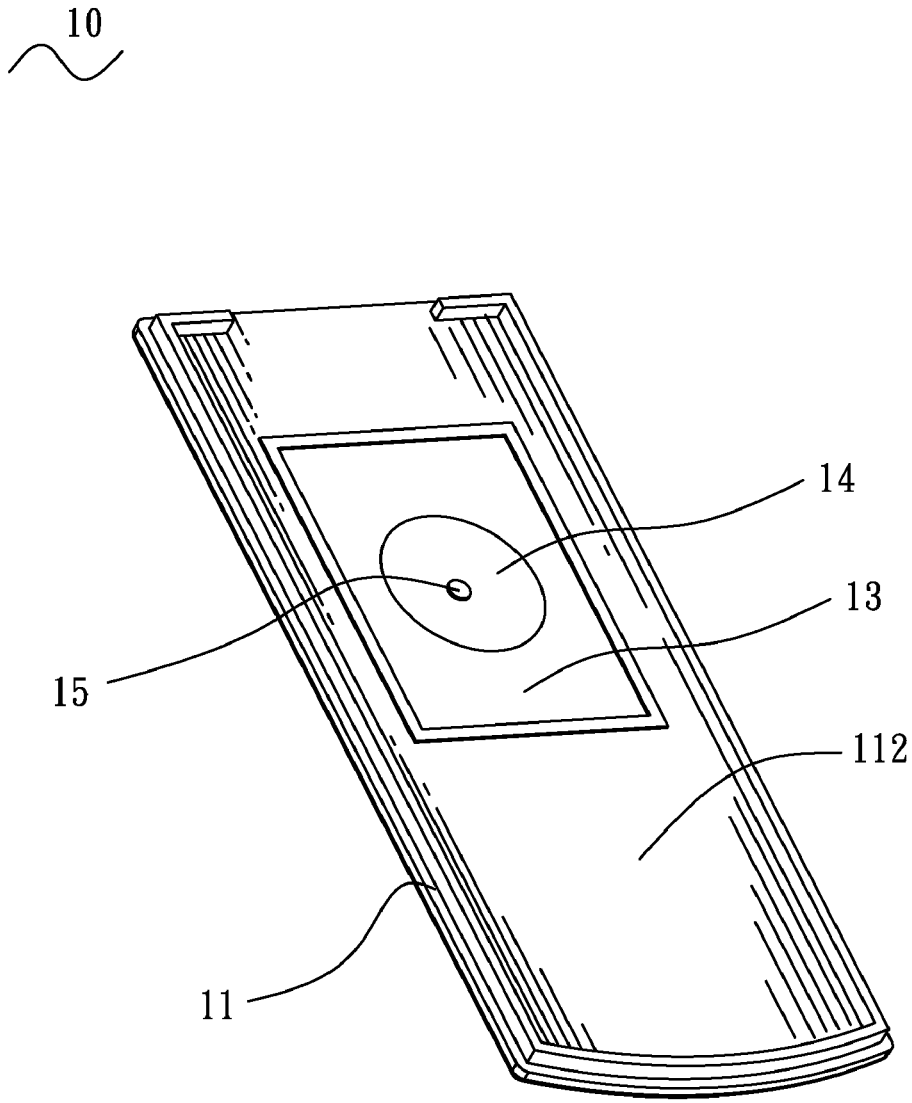
FIG. 3 is a perspective view of an upper cover of the wireless dongle of FIG. 1.

Referring to FIG. 2 and FIG. 3, the upper cover 10 has a rectangular base board 11. A bottom surface 112 of the base board 11 defines a rectangular restraining cavity 13 at an appropriate position thereof. A middle of the restraining cavity 13 further extends upward to form a cylindrical receiving cavity 14. An appropriate portion of the base board 11 located over the receiving cavity 14 is made of elastic materials to be acted as a switch section 12. The switch section 12 is further marked with noticeable signs (not shown) thereon. A middle of the switch section 12 protrudes into the receiving cavity 14 to form an inserting post 15.

Figure 5:
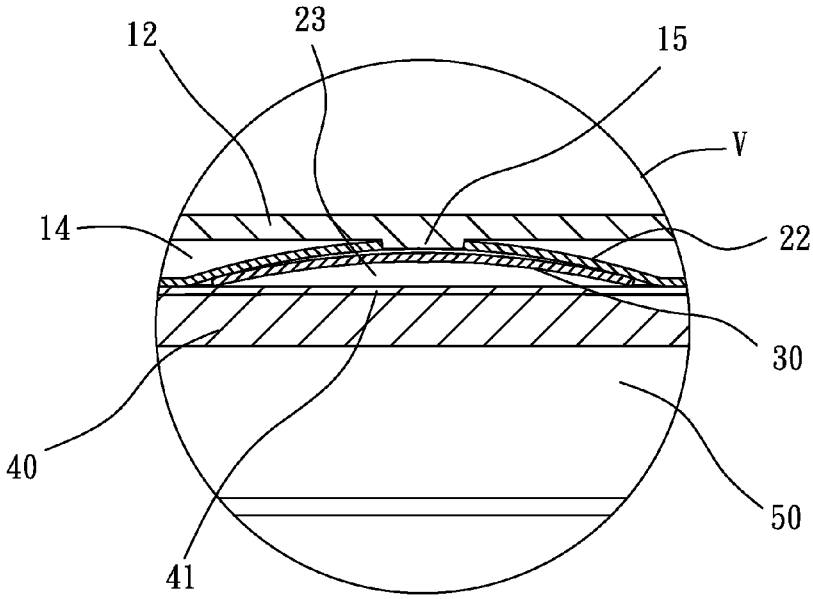
FIG. 5 is an enlarged view of an encircled portion V of FIG. 4.

Referring to FIG. 2 and FIG. 5, the restraining member 20 has a rectangular base plate 21 corresponding to the restraining cavity 13 of the upper cover 10. A middle of the base plate 21 is punched perpendicularly to the base plate 21 to form a spherical elastic portion 22 with a receiving fillister 23 being surrounded thereamong. A middle of the elastic portion 22 defines an inserting hole 24 penetrating therethrough to communicate with the receiving fillister 23. The elastic member 30 is made of elastic materials with a similar shape to the elastic portion 22. There is a contact area 41 formed on the printed circuit board 40.

Figure 4:
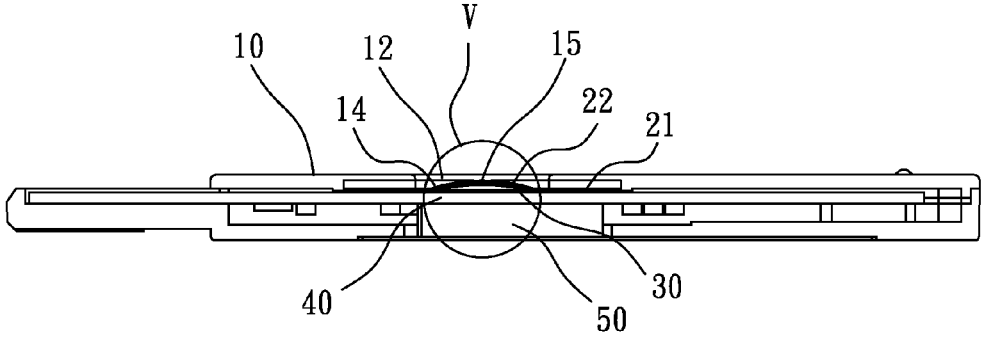
FIG. 4 is a cross-sectional view of the wireless dongle of FIG. 1.

Referring to FIG. 1, FIG. 4 and FIG. 5, during assembly, the base plate 21 of the restraining member 20 is buckled in the restraining cavity 13 of the upper cover 10, and the elastic portion 22 is received in the receiving cavity 14 under the switch section 12. The elastic member 30 is received in the receiving fillister 23 of the restraining member 20 and abuts against an inside of the elastic portion 22. The inserting post 15 of the upper cover 10 is inserted in the inserting hole 24 of the restraining member 20 with a free end thereof abutting against a peak of the elastic member 30. The lower cover 50 is mated with the upper cover 10 and the printed circuit board 40 is mounted in the lower cover 50 with the contact area 41 being covered under the elastic member 30 and spaced from the peak of the elastic member 30.

In use, the switch section 12 of the upper cover 10 is pressed to drive the inserting post 15 to press the elastic member 30 downward through the inserting hole 24 of the restraining member 20. As a result, the elastic member 30 is pressed by the inserting post 15 to contact the contact area 41 of the printed circuit board 40 so as to trigger an electrical signal. When the switch section 12 is set free, the elastic member 30 can reposition under self-elasticity that can further make the switch section 12 repositioned.

As described above, the switch section 12 made of elastic materials is designed with the appropriate portion of the base board 11 instead of an external dedicated button in the prior art. Thus, it can reduce a space requirement and advantageously lower a production cost.

What is claimed is:

1. A wireless dongle, comprising:

a shell having a base board, a bottom surface of the base board defining a restraining cavity having a middle portion extending upward to form a receiving cavity and a switch section formed over the receiving cavity;

a printed circuit board mounted in the shell and spaced from the base board of the shell, the printed circuit board defining a contact area facing toward the switch section of the shell;

an elastic member made of elastic materials and mounted between the switch section of the shell and the contact area of the printed circuit board, the elastic member being further spaced from the contact area, wherein the elastic member can be elastically pressed to contact the contact area of the printed circuit board by means of pressing the switch section of the shell against the elastic member so as to trigger an electrical signal; and a restraining member having a base plate buckled in the restraining cavity, a middle portion of the base plate being punched upward to form an elastic portion with a receiving fillister opened in a bottom thereof, the elastic portion being received in the receiving cavity under the switch section, and the elastic member being received in the receiving fillister against an inside of the elastic portion;

wherein a middle portion of the switch section protrudes into the receiving cavity to form an inserting post, a middle part of the elastic portion defines an inserting hole penetrating therethrough to communicate with the receiving fillister, and the inserting post is inserted in the inserting hole with a free end thereof abutting against a top of the elastic member.

* * * * *